US006830542B2

(12) United States Patent
Ball et al.

(10) Patent No.: US 6,830,542 B2
(45) Date of Patent: Dec. 14, 2004

(54) ROWING WEIGHT TRAINING MACHINE

(75) Inventors: Benjamin Ball, Independence, VA (US); Gregory M. Webb, Independence, VA (US)

(73) Assignee: Nautilus Human Performance Systems, Inc., Independence, VA (US)

( * ) Notice: Subject to any disclaimer, the term of this patent is extended or adjusted under 35 U.S.C. 154(b) by 399 days.

(21) Appl. No.: 09/886,413

(22) Filed: Jun. 21, 2001

(65) Prior Publication Data

US 2002/0187879 A1 Dec. 12, 2002

Related U.S. Application Data

(60) Provisional application No. 60/296,775, filed on Jun. 8, 2001.

(51) Int. Cl.[7] ..... A63B 69/06; A63B 21/062; A63B 71/00

(52) U.S. Cl. ..... 482/72; 482/100; 482/139

(58) Field of Search ..... 482/72, 97–98, 482/133–137, 100–101

(56) References Cited

U.S. PATENT DOCUMENTS

| | | | | | |
|---|---|---|---|---|---|
| 1,205,426 | A | * | 11/1916 | Barnhill | 482/72 |
| 3,966,201 | A | * | 6/1976 | Mester | 482/72 |
| 4,563,000 | A | * | 1/1986 | Gall | 482/72 |
| 4,949,951 | A | | 8/1990 | Deola | 272/134 |
| 5,304,107 | A | * | 4/1994 | Jones | 482/98 |
| 5,437,589 | A | * | 8/1995 | Habing | 482/72 |
| 5,547,444 | A | * | 8/1996 | Huang | 482/72 |
| 5,565,002 | A | * | 10/1996 | Rawls et al. | 482/6 |
| 5,620,402 | A | * | 4/1997 | Simonson | 482/72 |
| 6,264,585 | B1 | * | 7/2001 | Beauchamp | 482/72 |
| 6,561,960 | B2 | * | 5/2003 | Webber | 482/138 |

OTHER PUBLICATIONS

Pyramid Fitness Bio–Mechanical Engineers (Booklet).

* cited by examiner

*Primary Examiner*—Nicholas D. Lucchesi
*Assistant Examiner*—Fenn C. Mathew
(74) *Attorney, Agent, or Firm*—Myers Bigel Sibley & Sajovec

(57) ABSTRACT

A rowing weight training machine includes: a frame; a seat assembly attached to the frame; a movement arm pivotally attached to the frame and movable along a generally longitudinal stroke path between a forward position and a rearward position; a resistance-imparting unit operatively connected with the movement arm to provide resistance to the movement arm as it moves from the forward position to the rearward position; a pair of handles to be grasped by an exerciser; and a pair of extension members, each of which is attached to a respective handle such that each handle is free to rotate about a longitudinal axis of the extension member. The extension members are attached to the movement arm (preferably via a universal ball joint) such that each extension member is free to at least partially rotate relative to the movement arm about vertical, longitudinal and transverse axes. Also, the extension members are of sufficient length and the extension members are attached to the movement arm so that the handles can be separated by a distance of at least 24 inches when the movement arm is in the rearward position. In this configuration, the exerciser has the option of performing the basic rowing motion with the hands in any orientation, and can pull the handles along multiple vertical planes to multiple positions in front of the chest and shoulders or outside the chest and shoulders.

32 Claims, 7 Drawing Sheets

ROWING WEIGHT TRAINING MACHINE

RELATED APPLICATIONS

This application claims priority from co-assigned U.S. Provisional Application Ser. No. 60/296,775, filed Jun. 8, 2001, entitled Exercise Machines.

FIELD OF THE INVENTION

The present invention relates generally to exercise equipment, and relates more particularly to weight training equipment.

BACKGROUND OF THE INVENTION

Exercise devices, and in particular weight training machines, typically include a mechanical member that the user repeatedly moves along a prescribed path for exercise. Conventionally, movement of the mechanical member is resisted in some fashion (often by weights) to render the movement more difficult and thereby intensify the exercise. The movement of the mechanical member determines what muscle or muscle groups are to be involved in the exercise.

One popular exercise movement, both for aerobic and weight training, is the rowing motion, in which a seated exerciser extends his arms to grasp a handle or other grasping device and pulls the handle toward his body. This exercise movement tends to work the muscles of the upper back (such as the middle trapezius, rear deltoids, teres major, latissimus dorsi, and rhomboids) and the biceps.

In one type of rowing weight training machines, the handles grasped by the exerciser are either attached at the end of a cable or belt (often it is a single handle that is grasped with both hands). This configuration enables the user to pull with both hands at once, and to orient the hands so that the palms are either vertical or horizontal. However, with a single handle the user must have both hands oriented in the same direction, and the placement of the hands on the handle defines the vertical plane in which the hands move during the exercise (i.e., the direction of movement of the cable or belt).

Another type of rowing weight training machine has pivoting movement arms to which the grasping handles are attached. This type of machine typically has only a single path of motion available for exercise, and is often limited to a single orientation of the hands during grasping.

In view of the foregoing, it would be desirable to provide a rowing weight training machine that can provide multiple orientations of the hands and multiple vertical planes of movement during exercise, as doing so can exercise different muscles or portions thereof.

SUMMARY OF THE INVENTION

The present invention can provide a rowing weight training machine that has the capability of enabling the exerciser to employ multiple hand positions and multiple vertical planes of movement. In certain embodiments, the inventive rowing weight training machine comprises: a frame; a seat assembly attached to the frame; a movement arm pivotally attached to the frame and movable along a generally longitudinal stroke path between a forward position and a rearward position; a resistance-imparting unit operatively connected with the movement arm to provide resistance to the movement arm as it moves from the forward position to the rearward position; a pair of handles to be grasped by an exerciser; and a pair of extension members, each of which is attached to a respective handle such that each handle is free to rotate about a longitudinal axis of the extension member. The extension members are attached to the movement arm (preferably via a universal ball joint) such that each extension member is free to at least partially rotate relative to the movement arm about vertical, longitudinal and transverse axes. Also, the extension members are of sufficient length and the extension members are attached to the movement arm so that the handles can be separated by a distance of at least 24 inches when the movement arm is in the rearward position. In this configuration, the exerciser has the option of performing the basic rowing motion with the hands in any orientation, and can pull the handles along multiple vertical planes to multiple positions in front of the chest and shoulders or outside the chest and shoulders.

In other embodiments, the present invention is directed to an exercise machine that simulates a rowing motion, comprising: a frame; a seat assembly attached to the frame; a movement arm pivotally attached to the frame and movable along a generally longitudinal stroke path between a forward position and a rearward position; a resistance-imparting unit operatively connected with the movement arm to provide resistance to the movement arm as it moves from the forward position to the rearward position; a pair of handles to be grasped by an exerciser; and a pair of extension members, each of which is attached to a respective handle such that each handle is free to rotate about a longitudinal axis of the extension member. The extension members are attached to the movement arm such that each extension member is free to at least partially rotate relative to the movement arm about vertical, longitudinal and transverse axes. Also, a distance between the attachment of each extension member with the movement arm and the attachment of each extension member with its respective handle is between about 8 and 48 inches. In this configuration, the exercise machine can enjoy many of the advantages and benefits discussed above.

DETAILED DESCRIPTION OF THE INVENTION

Figure 1:
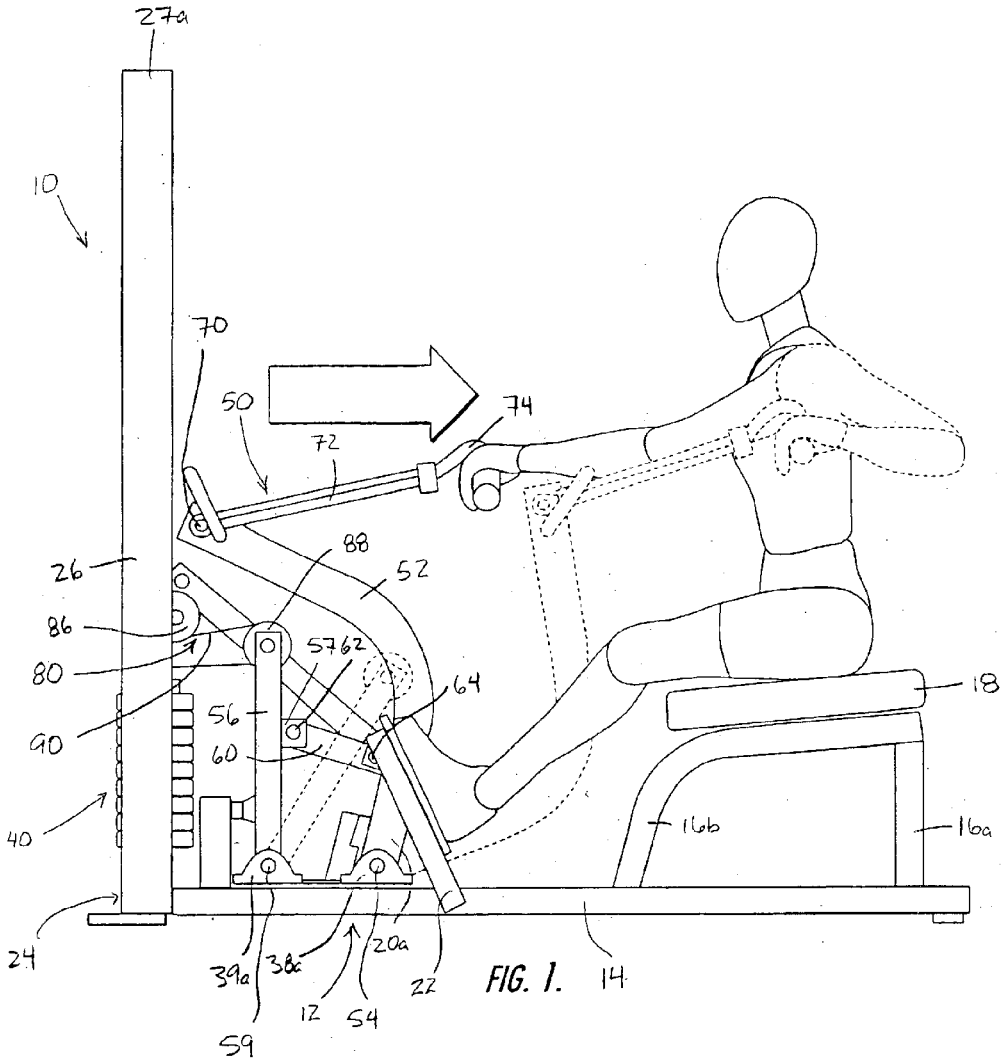
FIG. 1 is a side view of an embodiment of the rowing weight training machine of the present invention, with the forward position of the movement being illustrated in solid line and the rearward position being illustrated in dotted line.
Figure 2:
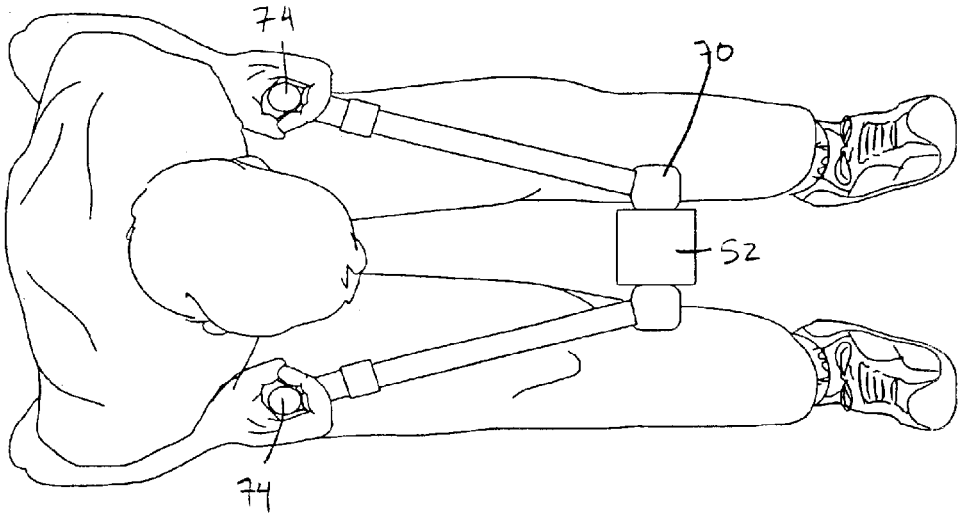
FIG. 2 is a partial top view of the machine of FIG. 1 showing the handles being pulled to the chest and oriented vertically.
Figure 3:
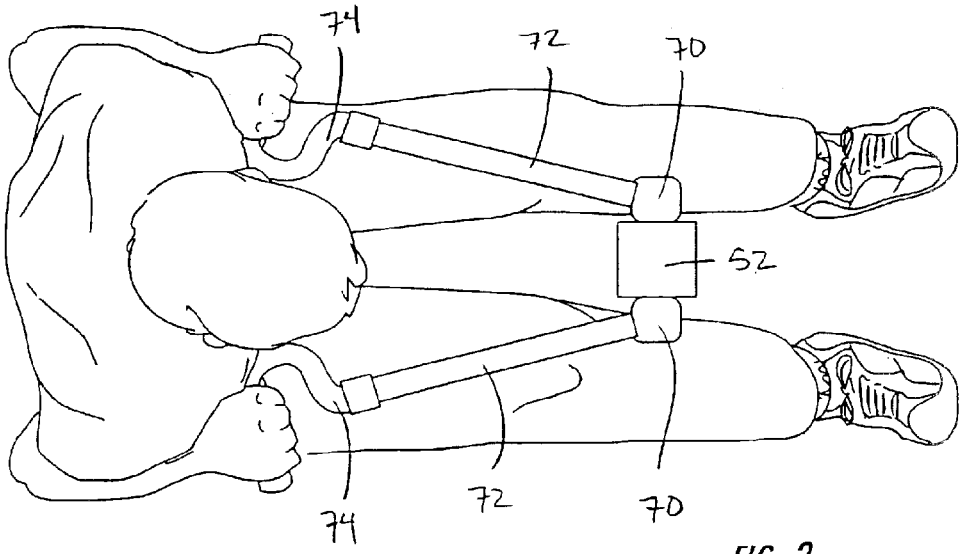
FIG. 3 is a partial top view of the machine of FIG. 1 showing the handles being pulled to the chest and oriented horizontally.
Figure 4:
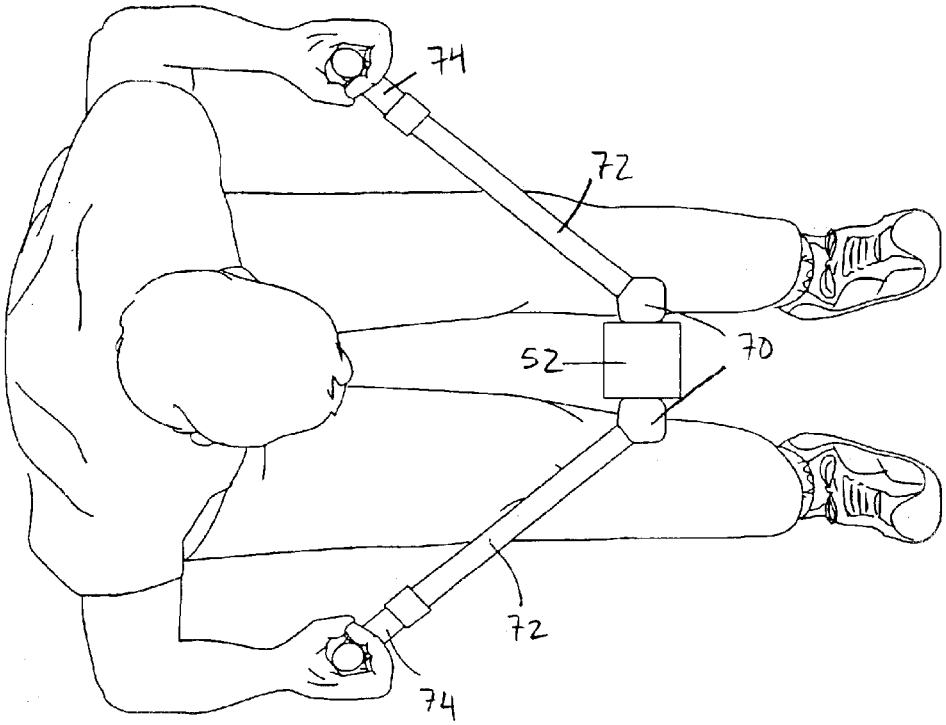
FIG. 4 is a partial top view of the machine of FIG. 1 showing the handles being pulled outside the shoulders and oriented vertically.
Figure 5:
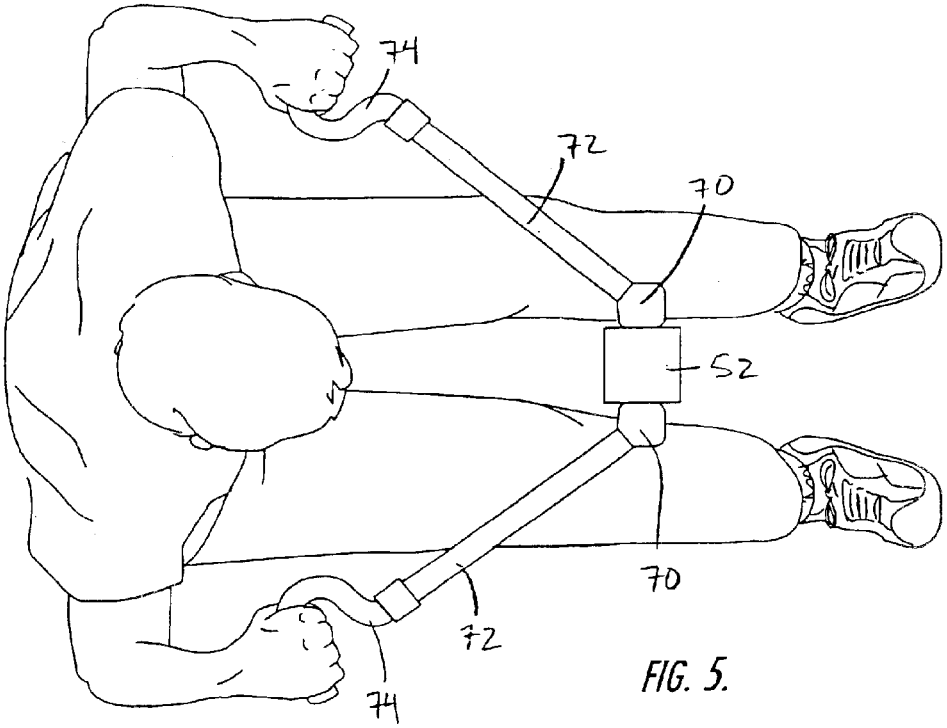
FIG. 5 is a partial top view of the machine of FIG. 1 showing the handles being pulled outside the shoulders and oriented horizontally.

The present invention will now be described more fully hereinafter, in which preferred embodiments of the invention are shown. This invention may, however, be embodied in different forms and should not be construed as limited to the embodiments set forth herein. Rather, these embodiments are provided so that this disclosure will be thorough and complete, and will fully convey the scope of the invention to those skilled in the art. In the drawings, like numbers refer to like elements throughout. Thicknesses and dimensions of some components may be exaggerated for clarity.

A rowing machine, designated broadly at 10, is illustrated in FIGS. 1-8. The rowing machine 10 includes a frame 12, a weight stack 40, a rowing assembly 50, and a belt-pulley system 80. These structures are described in greater detail below.

In describing the rowing machine 10, it will be assumed for the purposes of description that the terms "front", "forward", and derivatives thereof refer to the horizontal direction a seated exerciser faces (i.e., to the left as shown in FIG. 1). The term "rear" and derivatives thereof refer to the horizontal direction that is opposite the "forward" direction (i.e., to the right as shown in FIG. 1). Together, the "forward" and "rear" directions comprise the "longitudinal" dimension of the rowing machine 10. The terms "outward", "outer" and derivatives thereof refer to the horizontal direction defined by a vector beginning at the center of the machine 10 and extending perpendicularly to the longitudinal dimension; conversely, the terms "inner", "inward" and derivatives thereof refer to the horizontal direction opposite the "outward" direction. Together, the "inward" and "outward" directions comprise the "transverse" dimension of the machine 10.

Figure 6:
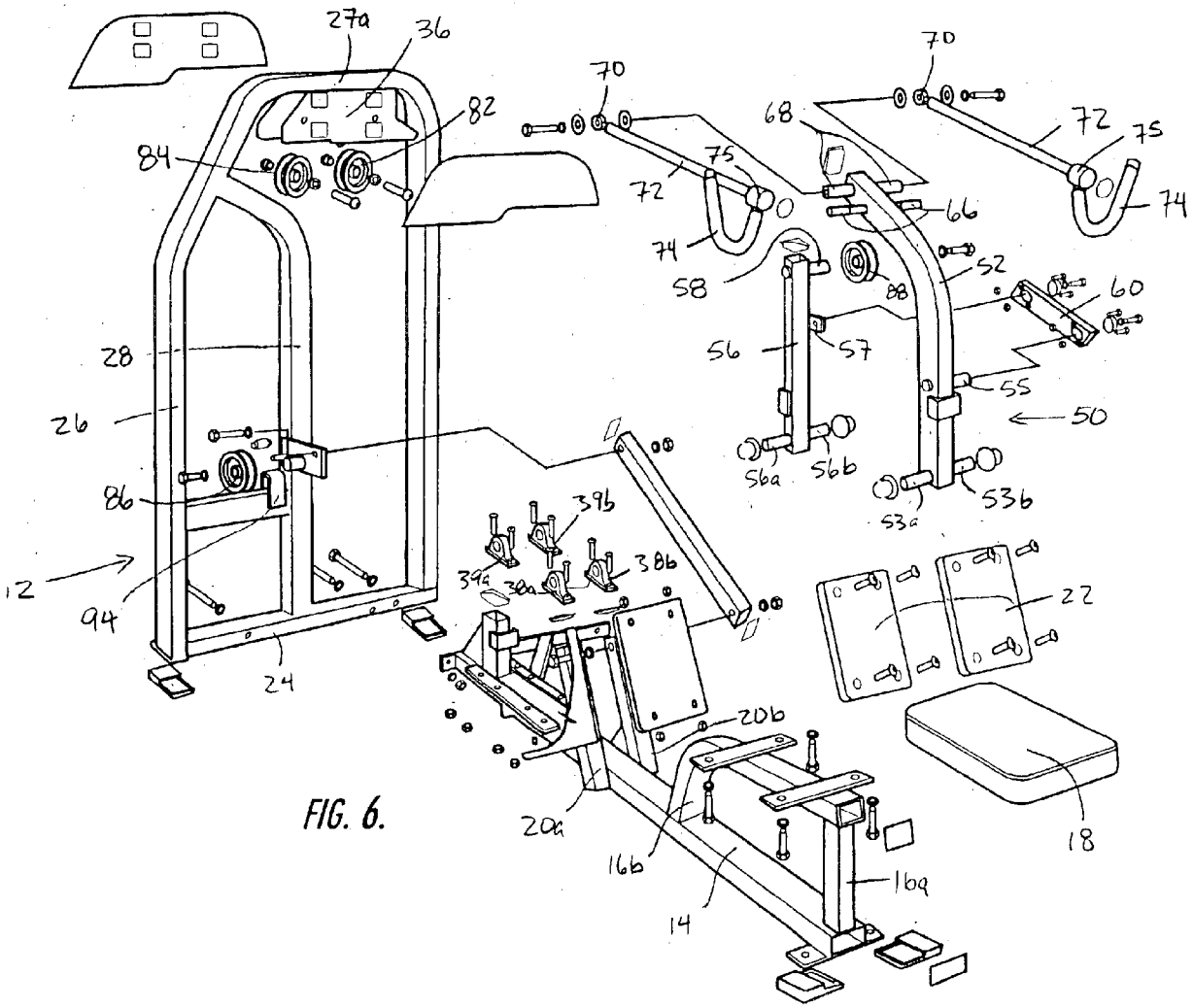
FIG. 6 is an exploded perspective view of the frame, seat assembly, movement arm assembly, and pulleys of the exercise machine of FIG. 1.

Referring now to FIGS. 1 and 6, the frame 12 includes an elongate, longitudinally-extending base member 14. A seat 18 is positioned above the base member 14 and is supported by two seat supports 16*a*, 16*b*. A pair of foot pads 22 are positioned forwardly of the seat 18 and are supported from beneath by foot supports 20*a*, 20*b*. The foot pads 22 are positioned relative to the seat 18 such that a seated exerciser can comfortably place his feet on the foot pads 22 with his knees in a slightly bent condition. Typically, the seat 18 will be positioned between about 10 and 24 inches above the underlying surface and the foot pads 22 will positioned between about 16 and 24 inches in front of the seat 18 at a height of between about 4 and 20 inches above the underlying surface and at an angle of between about 45 and 75 degrees to the underlying surface.

Still referring to FIGS. 1 and 6, the frame 12 also includes a base cross member 24 that extends generally perpendicularly to the base member 14 and attaches to the forward end thereof. A slightly asymmetric arch 26 rises from either end of the base cross member 24. A vertical support 28 rises from an intermediate portion of the base cross member 24 and curves to meet a sloped portion 27 of the arch 26. Also, a cross member 30 extends generally horizontally between the arch 26 and the vertical support 28 at a height of approximately 15 inches above the base cross member 24.

Referring again to FIGS. 1 and 6, the frame 12 also includes a longitudinal support 32 which attaches at one end to the foot support 20*a* and rises to attach at its opposite end to a longitudinal support bracket 34 that is mounted on the vertical support 28 just above the cross member 30. The frame 12 also includes an upper pulley bracket 36 that is mounted to and just below the uppermost portion 27*a* of the arch 26. In addition, the frame 12 includes a pair of mounting brackets 38*a*, 38*b* that are mounted to the base member 14 forwardly of the foot supports 20*a*, 20*b* and a pair of mounting brackets 39*a*, 39*b* that are mounted to the base member 14 forwardly of the mounting brackets 38*a*, 38*b*. The mounting brackets 38*a*, 38*b*, 39*a*, 39*b* serve as mounting points for the rowing assembly 50.

Those skilled in this art will recognize that the frame 12 illustrated herein is exemplary and can take many configurations that would be suitable for use with the present invention. The frame 12 provides a strong, rigid foundation to which other components can be attached at desired locations, and other frame forms able to serve this purpose may also be acceptable for use with this invention.

Figure 8:
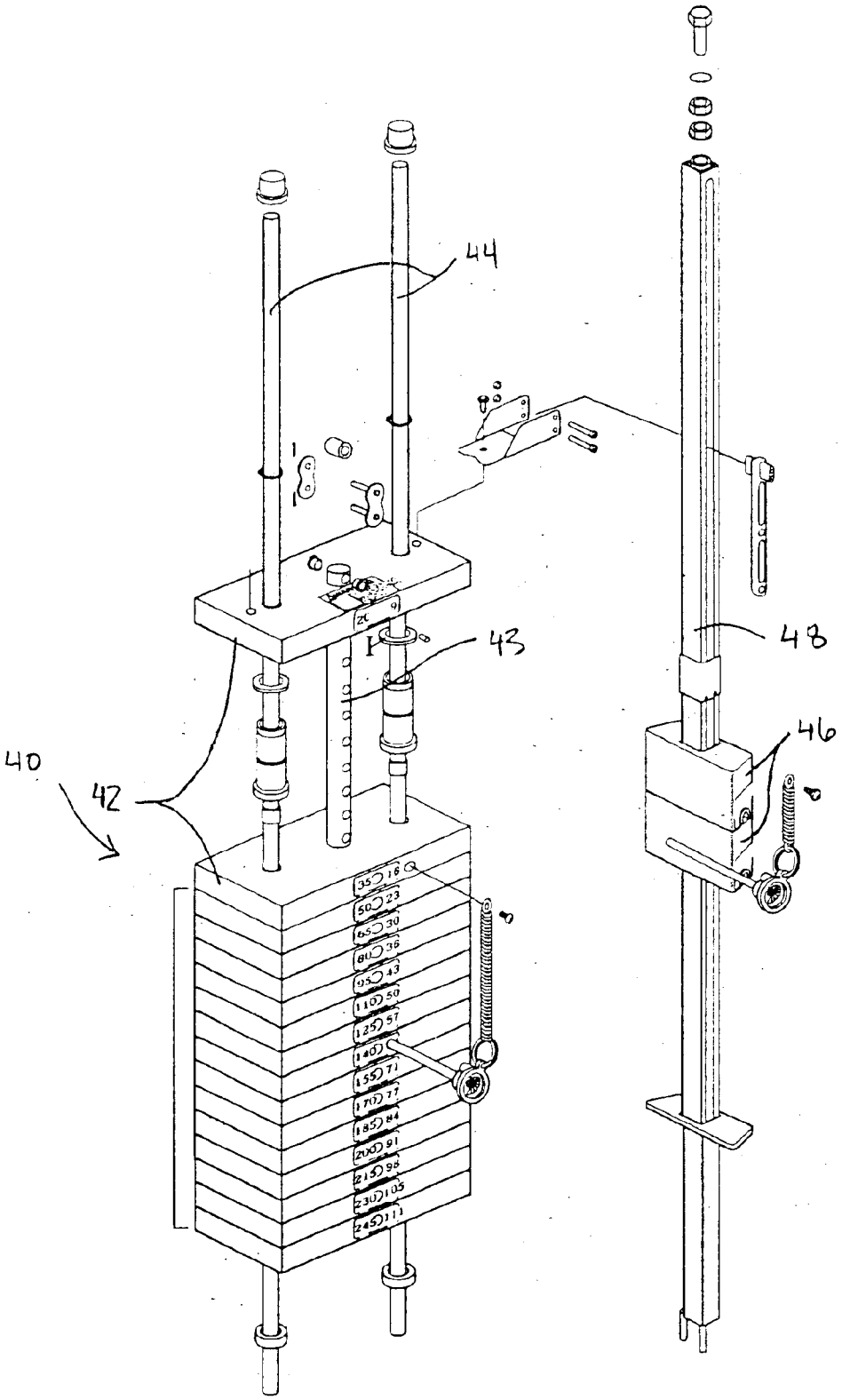
FIG. 8 is a partial exploded perspective view of the weight stack of the machine of FIG. 1.

Referring now to FIGS. 1 and 8, the weight stack 40 includes a set of weights 42 arranged in a vertical stack just above the base cross member 24. A lifting rod 43 extends vertically through apertures in the weights 42 and is configured to receive a pin inserted between individual weights 42 that enables the user to select the number of weights to be used in the exercise. The weight stack 40 also includes guide rods 44 that extend vertically through the weights 42 to guide the weights 42 along a vertical path during exercise. Weight stacks of this variety are well known to those skilled in this art and need not be described in detailed herein. In addition, the rowing machine 10 includes a set of auxiliary weights 46 that slide along a vertical guide rod 48 and that can be temporarily connected with the selected weights 42 to provide incremental weight during exercise. Again, auxiliary weight systems of this type are well known to those skilled in this art and need not be described in detail herein. An exemplary machine having such a weight stack is a leg extension machine available from Nautilus HPS, Inc. (Independence, Va.) under the trade name NITRO™.

Those skilled in this art will recognize that, although a weight stack is the preferred structure for providing resistance to the exerciser, other resistance-imparting structures, such as friction-imparting devices, variable viscosity devices, air drag-based resistance devices, and the like, may also be employed with a rowing machine of the present invention. Exemplary resistance devices include those illustrated in U.S. Pat. No. 5,810,096, 4,708,338; 4,720,093; 5,033,733; 4,542,897; 4,298,893; 4,805,901; 4,790,528; 4,786,049; 5,031,900; 4,775,145; 4,589,656;and 4,659,074, the disclosures of each of which are hereby incorporated herein by reference in their entireties.

Referring back to FIGS. 1 and 6, the rowing assembly 50 includes a movement arm 52, a swing link 56, connecting link 60, and main handles 74. The movement arm 52 is attached to the mounting brackets 38*a*, 38*b* via a transversely extending pivot posts 53*a*, 53*b* located on each side thereof to form a pivot 54. The movement arm 52 extends first upwardly, then curves upwardly and forwardly at an angle of approximately 10 degrees to the underlying surface. A pivot post 55 extends transversely from the lower vertical portion of the movement arm 52. The movement arm 52 also includes a pair of stops 66 that extend transversely from the upper end thereof. In addition, a pair of handle mounting posts 68 extend transversely from the upper end portion of the movement arm 52.

Still referring to FIGS. 1 and 6, the swing link 56 is a straight link that is attached to the mounting brackets 39*a*, 39*b* at a pivot 59 via pivot posts 56*a*, 56*b*. A pivot bracket 57 is located at an intermediate point on the swing link 56. Also, the upper end of the swing link 56 includes a pulley pin 58 that extends transversely therefrom.

Referring again to FIGS. 1 and 6, the connecting link 60 extends between and is pivotally connected to the pivot post 55 of the movement arm 52 and the pivot bracket 57 of the swing link 56 to form, respectively, pivots 62, 64. Thus, the movement arm 52, swing link 56, connecting link 60 and base member 14 form a four-bar linkage that controls their relative movement.

Referring yet again to FIGS. 1 and 6, the main handles 74 are attached to the movement arm 52 via respective universal ball joints 70. More specifically, each ball joint 70 is attached to a handle mounting post 68, and an extension rod 72 is attached at one end to the ball joint 70. Attachment via the ball joint 70 enables the extension rod 72 to rotate at least to a certain extent about vertical, longitudinal and transverse axes. Typically, the extension rod 72 can rotate about 270 degrees about the transverse axis, about 50 to 120 degrees about the longitudinal axis, and about 50 to 120 degrees about the vertical axis. At its opposite end, the extension rod 72 is attached to a rotary bearing 75 (such as a sleeve or ball bearing) on the end of the main handle 74 such that the handle 74 is free to rotate 360 degrees about the longitudinal axis of the extension rod 72. Preferably, the extension rod 72 is of sufficient length (between about 8 and 48 inches, and more preferably between about 20 and 24 inches) to enable the handles 74 to be separated by between about 0 and 36 inches, and preferably at least 24 inches, when pulled by the exerciser to a longitudinal position approximately equal to that of the front of the seat 34.

Figure 7:
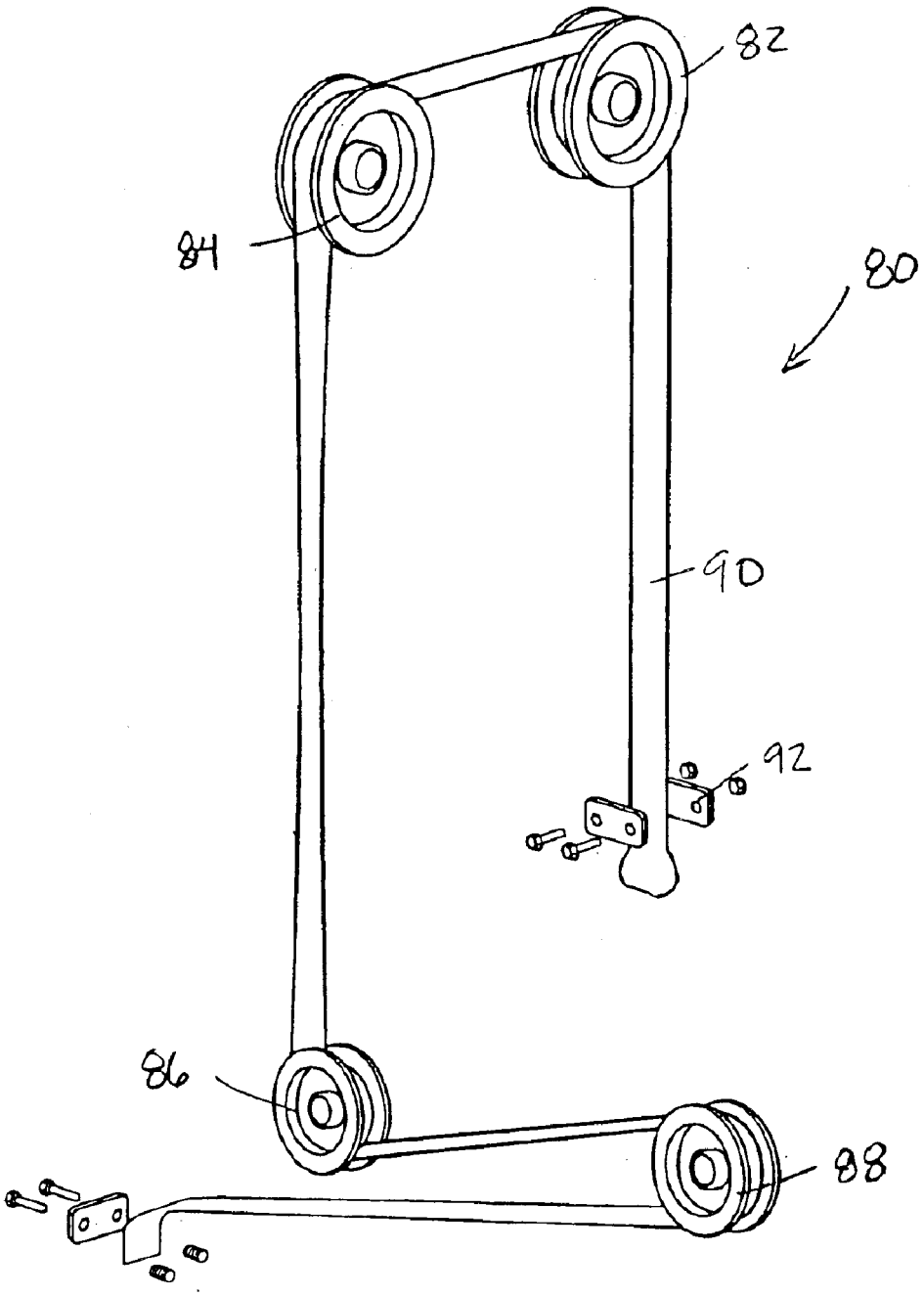
FIG. 7 is a partial perspective view of the belt/pulley system of the machine of FIG. 1.

Referring now to FIGS. 1, 6 and 7, the belt/pulley system 80 includes upper pulleys 82 and 84 that are mounted to the upper pulley bracket 36; the upper pulley 82 is mounted substantially directly above the center of the weight stack 40, and the upper pulley 84 is mounted near the vertical support 28. An intermediate pulley 86 is mounted on the longitudinal support bracket 34 just below and forward of longitudinal support 32. A swing link pulley 88 is attached to the pulley pin 58 located at the upper end of the swing link 56.

Referring still to FIGS. 1 and 7, a belt 90 engages the aforementioned pulleys 82, 84, 86, 88 to connect the weight stack 40 to the movement arm 52. More specifically, the belt 90 is attached at one end to a belt mounting bracket 92 that is mounted to the lifting member 43, and at its opposite end to a belt mounting bracket 94 that is mounted to the cross member 30. The belt 90 traces a path from the belt mounting bracket 92 upwardly to the upper pulley 82, horizontally to the upper pulley 84, downwardly to the intermediate pulley 86, rearwardly to the swing link pulley 88, and forwardly back to the belt mounting bracket 94.

In operation, the user first selects a desired resistance from the weight stack 40. He then is seated on the seat 18 facing the arch 26 with his feet placed on the foot pads 22, at which point the movement arm 52 is in the forward position illustrated in FIG. 1 in solid line. He grasps the main handles 74 in front of his body and pulls the main handles 74 toward him. Doing so causes the movement arm 52 and, in turn, the swing link 56, to pivot about, respectively, pivots 54 and 59, such that the movement arm moves to the rearward position illustrated in FIG. 1 in dotted line and the upper end of the swing link 56 moves rearwardly. This movement draws the swing link pulley 88 rearwardly, which pulls the belt 90 rearwardly. This movement of the belt 90 causes the remainder of the belt to slide along the path between the pulleys 82, 84, 86, 88 described above and away from the weight stack 40. As such, the selected weights rise with the belt 90 and provide resistance to the user.

Notably, the ball joints 70 enable the user to hold the main handles 74 in a variety of different positions that can exercise different portions of the body. For example, the main handles 74 can be rotated about the axes defined by their respective extension rods 72 and therefore may be oriented vertically, horizontally, or some intermediate position, each of which will cause different muscle groups to be exercised. For example, if the handles are held vertically (see FIGS. 2 and 4), more emphasis is placed on exercise of the brachioradialis, while a horizontal orientation of the handles (see FIGS. 3 and 5) causes exercise of the pronator teres to be more intense.

In addition, the presence of the ball joints 70 enables the main handles 74 to be drawn outwardly (away from the center of the body) during exercise, again providing exercise to different muscle groups in the body. In particular, the inclusion of the extension rod 72 between the ball joints 70 and the main handle 74 allows the exerciser to position the handles further apart than the typical width of a human body (for example, the handles may be separated by between 0 and 36 inches, and preferably at least 24 inches) while still enabling the main handle 74 to be turned and/or raised during exercise. Thus, with the handles 74 drawn to a position adjacent the shoulders or chest (see FIGS. 2 and 3), exercise of the latissimus dorsi may be emphasized, while drawing the handles 74 to a position 2 inches outside the shoulders (see FIGS. 4 and 5) can exercise the posterior deltoid and rhomboids more intensely.

Moreover, the ball joints 70 enable the exerciser to pull the handles 74 to different elevations on the body. For example, although FIGS. 2-5 demonstrate the pulling motion of the exerciser drawing the handles 74 to the chest level of the exerciser, the exerciser may bring the handles 74 to a lower or higher elevation and exercise different muscles.

Those skilled in this art will appreciate that other structures, such as rubber joints, cable joints, universal joints, hook and loop joints, chain links, and dual axis joints, may be used in place of the ball joints 70. The replacement structures should be capable of allowing the extension rods 72 to rotate at least partially about vertical, longitudinal and transverse axes.

Figure 9:
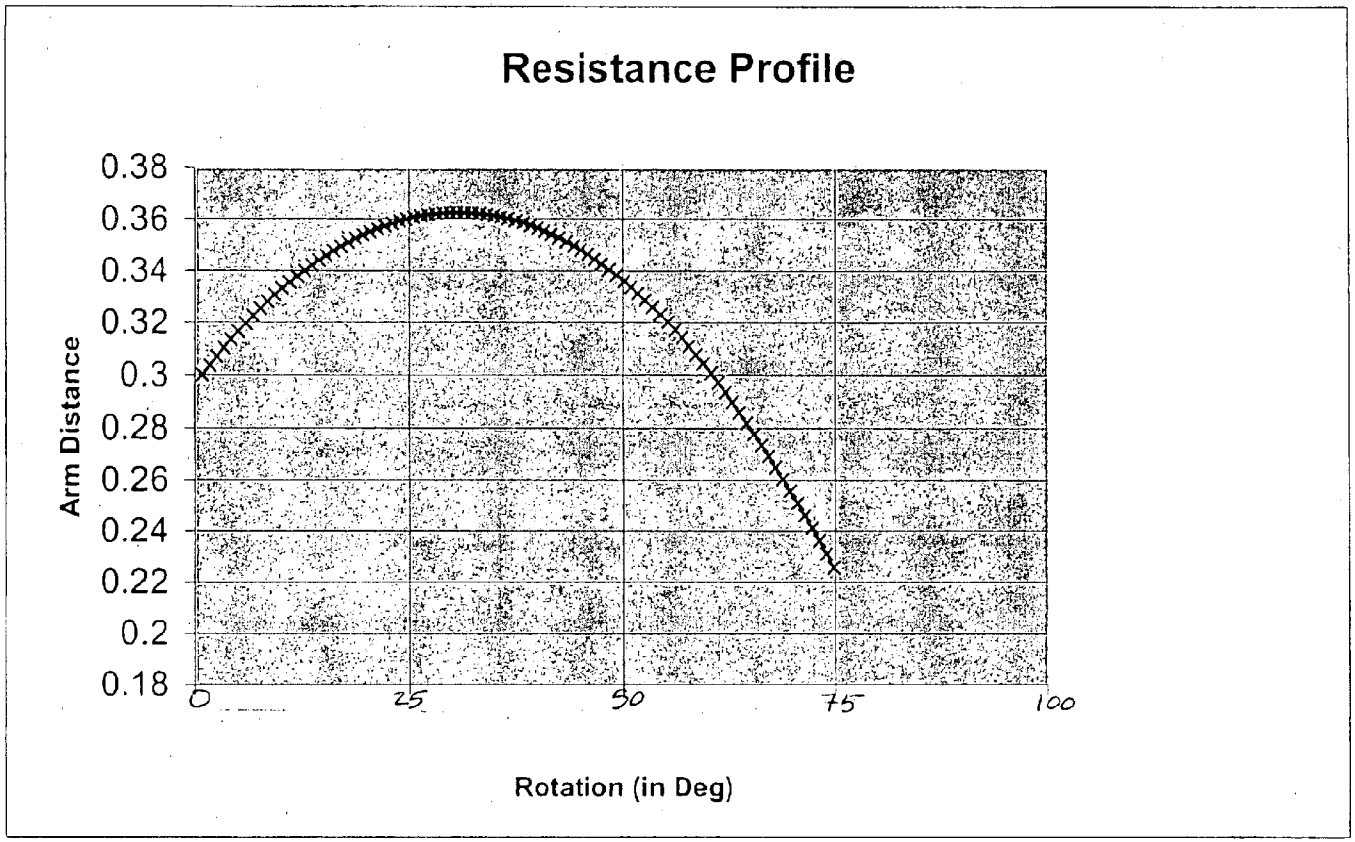
FIG. 9 is a graph plotting resistance as a function of movement arm displacement for the machine of FIG. 1.

Further, the configuration of the aforementioned four-bar linkage controls the resistance curve experienced by the exerciser during exercise. Fundamentally, it is desirable to vary the resistance experienced by the exerciser at different points during movement; otherwise, the magnitude of resistance necessary to provide a strengthening workout to a muscle or muscle group may be too high to enable the user to move the movement arm through positions in the full range of motion in which the user enjoys a lower mechanical advantage. In the illustrated embodiment, the movement of the pulley 88 with the swing link 56 causes the resistance experienced by the exerciser to follow the resistance curve illustrated in FIG. 9. Those skilled in this art will recognize that, although a four-bar linkage is preferred to provide a varying resistance curve to the machine 10, other structures, such as cams and the like, can also be employed to vary the resistance of the machine during exercise.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

That which is claimed is:

1. An exercise machine that simulates a rowing motion, comprising:

a frame;

a seat assembly attached to the frame;

a movement arm pivotally attached to the frame and movable along a generally longitudinal stroke path between a forward position and a rearward position;

a resistance-imparting unit operatively connected with the movement arm to provide resistance to the movement arm as it moves from the forward position to the rearward position;

a pair of handles to be grasped by an exerciser;

a pair of rigid extension members, each of which is attached to a respective handle such that each handle is free to rotate relative to its corresponding extension member about a longitudinal axis of the extension member;

wherein the extension members are attached to the movement arm such that each extension member is free to at least partially rotate relative to the movement arm about vertical, longitudinal and transverse axes; and wherein the extension members are of sufficient length and the extension members are attached to the movement arm so that the handles can be separated by a distance of at least 24 inches when the movement arm is in the rearward position.

2. The exercise machine defined in claim 1, wherein the resistance-imparting unit comprises a weight stack.

3. The exercise machine defined in claim 1, wherein the extension members have a length between about 8 and 48 inches.

4. The exercise machine defined in claim 1, wherein each of the extension members is attached to the movement arm via a ball joint.

5. The exercise machine defined in claim 1, wherein each handle is attached to its respective extension member via a rotary bearing.

6. The exercise machine defined in claim 1, further comprising a unit that varies the resistance imparted to the exerciser by the resistance-imparting unit along the stroke path.

7. The exercise machine defined in claim 6, wherein the unit that varies resistance comprises a four-bar linkage that includes the movement arm.

8. The exercise machine defined in claim 7, wherein the four bar linkage includes a swing link pivotally interconnected to the frame.

9. The exercise machine defined in claim 8, wherein the resistance-imparting unit is a weight stack, and wherein the weight stack is interconnected with the movement arm via a belt, and wherein a pulley that engages the belt is attached to the swing link.

10. An exercise machine that simulates a rowing motion, comprising:

a frame;

a seat assembly attached to the frame;

a movement arm pivotally attached to the frame and movable along a generally longitudinal stroke path between a forward position and a rearward position;

a resistance-imparting unit operatively connected with the movement arm to provide resistance to the movement arm as it moves from the forward position to the rearward position;

a pair of handles to be grasped by an exerciser;

a pair of rigid extension members, each of which is attached to a respective handle such that each handle is free to rotate relative to its corresponding extension member about a longitudinal axis of the extension member;

wherein the extension members are attached to the movement arm such that each extension member is free to at least partially rotate relative to the movement arm about vertical, longitudinal and transverse axes; and wherein a distance between the attachment of each extension member with the movement arm and the attachment of each extension member with its respective handle is between about 8 and 48 inches.

11. The exercise machine defined in claim 10, wherein each of the extension members is attached to the movement arm via a universal ball joint.

12. The exercise machine defined in claim 10, wherein each handle is attached to its respective extension member via a sleeve bearing.

13. The exercise machine defined in claim 10, further comprising a unit that varies the resistance imparted to the exerciser by the resistance-imparting unit along the stroke path.

14. The exercise machine defined in claim 13, wherein the unit that varies resistance comprises a four-bar linkage that includes the movement arm.

15. The exercise machine defined in claim 14, wherein the four bar linkage includes a swing link pivotally interconnected to the frame.

16. The exercise machine defined in claim 15, wherein the resistance-imparting unit is a weight stack, and wherein the weight stack is interconnected with the movement arm via a belt, and wherein a pulley that engages the belt is attached to the swing link.

17. An exercise machine that simulates a rowing motion, comprising:

a frame;

a seat assembly attached to the frame;

a movement arm pivotally attached to the frame and movable along a generally longitudinal stroke path between a forward position and a rearward position;

a resistance-imparting unit operatively connected with the movement arm to provide resistance to the movement arm as it moves from the forward position to the rearward position;

a pair of handles to be grasped by an exerciser;

a pair of rigid extension members, each of which is attached to a respective handle such that each handle is free to rotate relative to its corresponding extension member about a longitudinal axis of the extension member;

wherein the extension members are attached to the movement arm via a ball joint such that each extension member is free to at least partially rotate relative to the movement arm about vertical, longitudinal and transverse axes.

18. The exercise machine defined in claim 17, wherein the resistance-imparting unit comprises a weight stack.

19. The exercise machine defined in claim 17, wherein the extension members have a length between about 8 and 48 inches.

20. The exercise machine defined in claim 17, wherein each handle is attached to its respective extension member via a rotary bearing.

21. The exercise machine defined in claim 17, further comprising a unit that varies the resistance imparted to the exerciser by the resistance-imparting unit along the stroke path.

22. The exercise machine defined in claim 21, wherein the unit that varies resistance comprises a four-bar linkage that includes the movement arm.

23. The exercise machine defined in claim 22, wherein the four bar linkage includes a swing link pivotally interconnected to the frame.

24. The exercise machine defined in claim 23, wherein the resistance-imparting unit is a weight stack, and wherein the weight stack is interconnected with the movement arm via a belt, and wherein a pulley that engages the belt is attached to the swing link.

25. An exercise machine that simulates a rowing motion, comprising:

a frame;

a seat assembly attached to the frame;

a movement arm pivotally attached to the frame and movable along a generally longitudinal stroke path between a forward position and a rearward position;

a resistance-imparting unit operatively connected with the movement arm to provide resistance to the movement arm as it moves from the forward position to the rearward position;

a pair of handles to be grasped by an exerciser;

a pair of rigid extension members, each of which is attached to a respective handle such that each handle is free to rotate relative to its corresponding extension member about a longitudinal axis of the extension member that is generally parallel with the stroke path;

wherein the extension members are attached to the movement arm such that each extension member is free to at least partially rotate relative to the movement arm about vertical, longitudinal and transverse axes.

26. The exercise machine defined in claim 25, wherein the resistance-imparting unit comprises a weight stack.

27. The exercise machine defined in claim 25, wherein the extension members have a length between about 8 and 48 inches.

28. The exercise machine defined in claim 25, wherein each handle is attached to its respective extension member via a rotary bearing.

29. The exercise machine defined in claim 25, further comprising a unit that varies the resistance imparted to the exerciser by the resistance-imparting unit along the stroke path.

30. The exercise machine defined in claim 29, wherein the unit that varies resistance comprises a four-bar linkage that includes the movement arm.

31. The exercise machine defined in claim 30, wherein the four bar linkage includes a swing link pivotally interconnected to the frame.

32. The exercise machine defined in claim 31, wherein the resistance-imparting unit is a weight stack, and wherein the weight stack is interconnected with the movement arm via a belt, and wherein a pulley that engages the belt is attached to the swing link.

* * * * *